US007854692B2

(12) United States Patent
Prstojevich et al.

(10) Patent No.: US 7,854,692 B2
(45) Date of Patent: Dec. 21, 2010

(54) REACTION TRAINING BELT WITH VARIABLE RELEASE RESISTANCE

(75) Inventors: Mike Prstojevich, Portland, OR (US); William Dieter, Portland, OR (US); James Thorne, Portland, OR (US); Bora Erdos, Los Angeles, CA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/176,715

(22) Filed: Jul. 21, 2008

(65) Prior Publication Data

US 2009/0118107 A1 May 7, 2009

Related U.S. Application Data

(60) Provisional application No. 60/951,190, filed on Jul. 20, 2007.

(51) Int. Cl.
*A63B 21/002* (2006.01)
*A63B 67/00* (2006.01)

(52) U.S. Cl. ..... 482/91; 273/451

(58) Field of Classification Search ..... 482/121, 482/129, 124, 139, 91; 273/452, 440, 451; 434/234; 24/303

See application file for complete search history.

(56) References Cited

U.S. PATENT DOCUMENTS 4,026,548 A * 5/1977 Birdwell ..... 482/129
4,153,245 A * 5/1979 McCoy ..... 273/451
4,346,884 A * 8/1982 Warehime ..... 273/451
4,572,511 A * 2/1986 Barringer ..... 273/451
4,651,989 A 3/1987 Wilson
5,002,273 A 3/1991 Sela
5,713,307 A * 2/1998 Polston et al. ..... 119/708
5,746,672 A * 5/1998 Smith ..... 473/464
5,951,443 A 9/1999 Askins
6,601,539 B1 * 8/2003 Snook ..... 119/710
6,857,169 B2 * 2/2005 Chung ..... 24/303
7,234,208 B2 * 6/2007 Harley ..... 24/303
7,308,737 B2 * 12/2007 Saitoh et al. ..... 24/303
7,384,382 B2 * 6/2008 Farrah et al. ..... 482/124
7,438,669 B1 * 10/2008 Bloom ..... 482/49
2005/0192169 A1 * 9/2005 Girgen et al. ..... 482/139
2009/0000565 A1 * 1/2009 Bryce ..... 119/707

OTHER PUBLICATIONS

International Search Report; PCT app. No. PCT/US08/070631; Jul. 21, 2008; 2 pages.
Written Opinion of the International Searching Authority; PCT app. No. PCT/US08/070631; Jul. 21, 2008; 4 pages.
Notification of Transmittal of the International Search Report; PCT app. No. PCT/US08/070631; Jul. 21, 2008; 1 page.

* cited by examiner

*Primary Examiner*—Fenn C Mathew
(74) *Attorney, Agent, or Firm*—Banner & Witcoff, Ltd

(57) ABSTRACT

A cost effective training belt that offers the ability to vary the release resistance and that allows the release resistance to remain relatively constant throughout the life of the belt. In one disclosed embodiment, the reaction belt has a first and second belt detachably secured together with a detaching structure that can connect the first and second belts together in at least two different ways. Each of the connecting ways offers a different release resistance; thereby a user can select the desired release resistance by selecting which way to connect the two belts together.

12 Claims, 3 Drawing Sheets

REACTION TRAINING BELT WITH VARIABLE RELEASE RESISTANCE

CROSS-REFERENCE TO RELATED APPLICATION

This application claims priority to U.S. provisional patent application Ser. No. 60/951,190, filed on Jul. 20, 2007.

FIELD OF THE INVENTION

The present invention relates to a reaction belt, which is also commonly known as a shadow belt, that detachably tethers one athlete to another usually for training purposes.

BACKGROUND OF THE INVENTION

Reaction training belts, which are also known as shadow belts, are commonly used by athletes to develop and improve their agility, reaction time and quickness. In general, a reaction belt detachably tethers one athlete to another. During use, one of the athletes attempts to move away from the other athlete so as to detach the tether between them. The other athlete attempts to move with the first athlete so as to prevent the tether from becoming detached. The second athlete attempts to keep the tether attached to the other athlete as long as possible.

Athletes can perform a variety of pursuit and reaction drills that add another dimension to training. Ideally, athletes are matched evenly for speed, quickness and agility so that it provides a greater challenge and forces the drill to last longer. The drill can match sport specific positions against each other and can be focused on an area similar to the distance each position runs or moves in a game.

Known reaction belts are usually detachably secured with a detaching structure that do not allow for the release resistance to be adjusted. For example, know reaction belts attach via hook and loop material and the like.

Moreover, these known attachment structures tend to deteriorate over time, thereby compromising their durability.

SUMMARY OF THE INVENTION

Accordingly, despite the known reaction belts, there remains a need for a cost effective training belt that offers the ability to vary the release resistance and that allows the release resistance to remain relatively constant throughout the life of the belt. These and other improvement is found in the present invention.

In one disclosed embodiment, the reaction belt has a first and second belt detachably secured together with a detaching structure that can connect the first and second belts together in at least two different ways. Each of the connecting ways offers a different release resistance; thereby a user can select the desired release resistance by selecting which way to connect the two belts together.

DETAILED DESCRIPTION OF PREFERRED EMBODIMENTS

A reaction training belt system 10 having a first belt 10*a* detachably secured to a second belt 10*b* by a detaching structure 12 that allows the release resistance to be adjusted is shown in FIGS. 1-3D.

Figure 1:
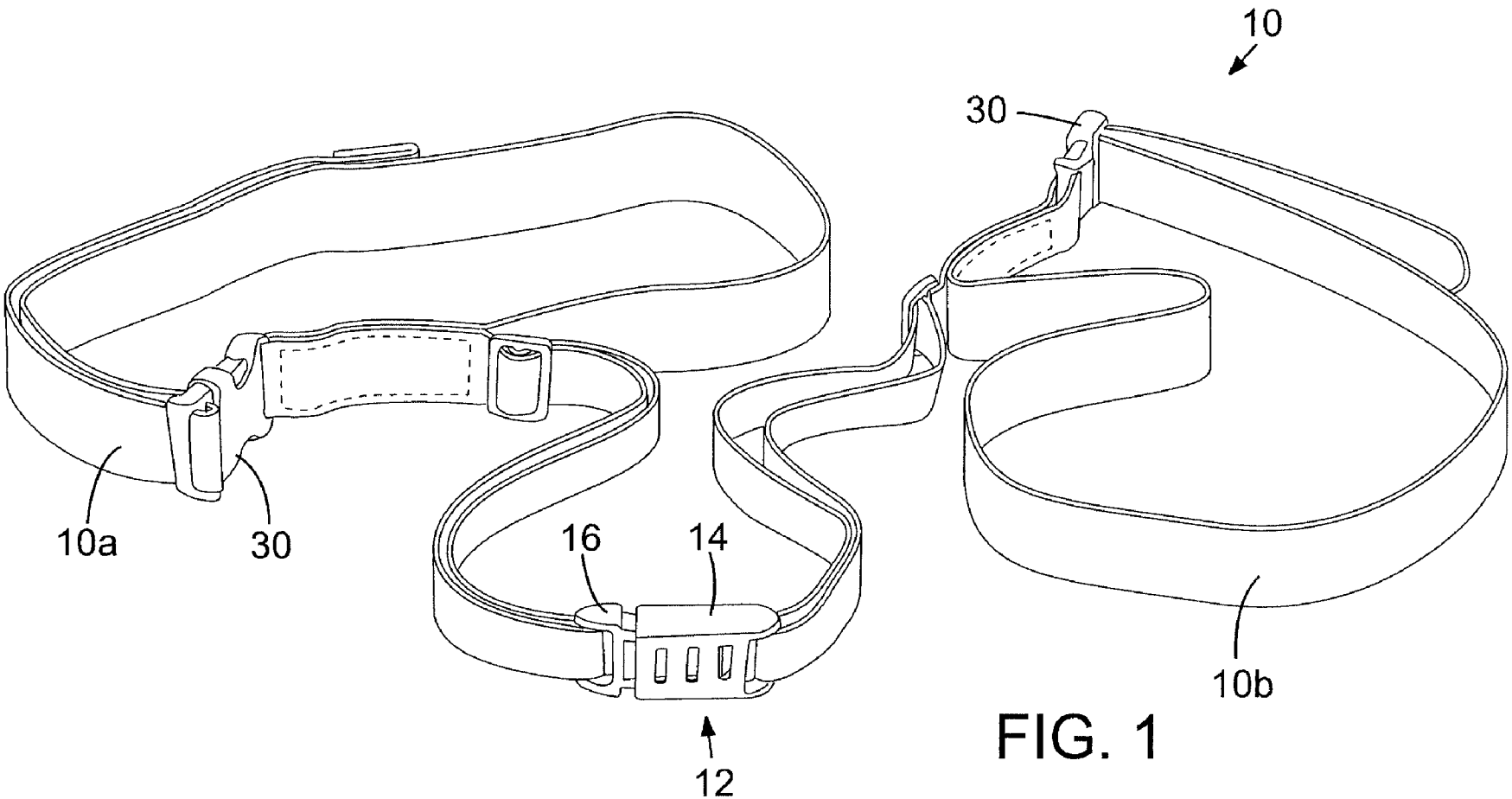
FIG. 1 is an isometric view of a reaction training belt system having two portions that are detachably secured together with a detaching structure that offers the release resistance to be adjusted in accordance with an embodiment of the present invention.
Figure 2:
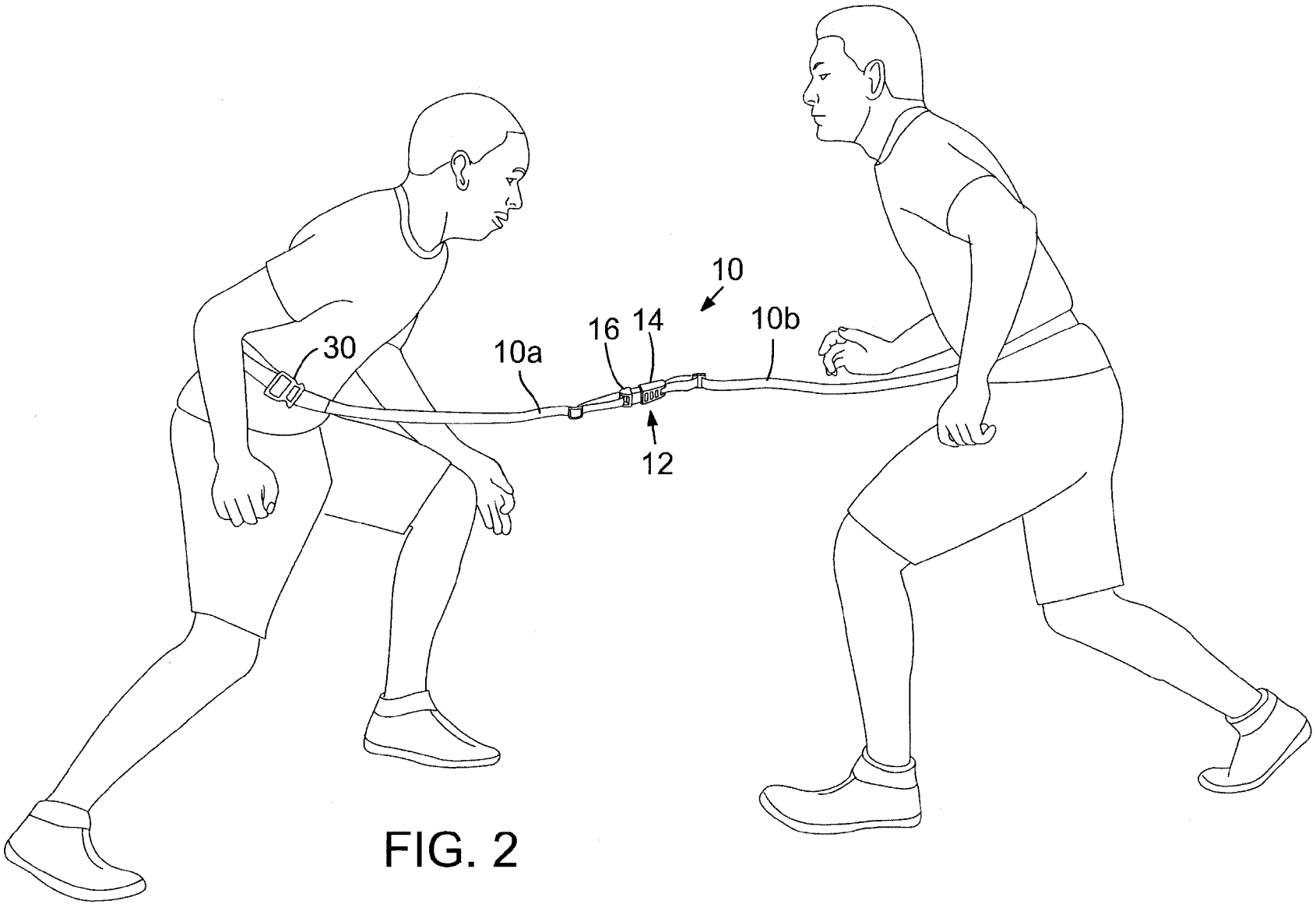
FIG. 2 is the reaction training belt system of FIG. 1 showing a possible use by two athletes.

The first and second belts 10*a*, 10*b* are formed of a flexible material, and they are preferably adjustable so as to be operably secured around an athlete as best shown in FIG. 2. Preferably, the distal ends of each belt 10*a*, 10*b* are joined to the detaching structure 12.

One possible detaching structure 12 is shown in FIGS. 1-3D. Preferably, the detaching structure 12 has a male portion 16 operably received within a female portion 14. Protrusions 15 extending from the sides of the male portion operably engage one pair of a plurality of openings 18*a*-*c*, aligned on the female portion as shown. Each pair of openings 18*a*-*c* is preferably sized so as to offer a different degree of release resistance at which the protrusions 15 will detach from the opening 18*a*-*c* when the two belts 10*a*-10*b* are urged in different directions from each other.

Figure 3A:
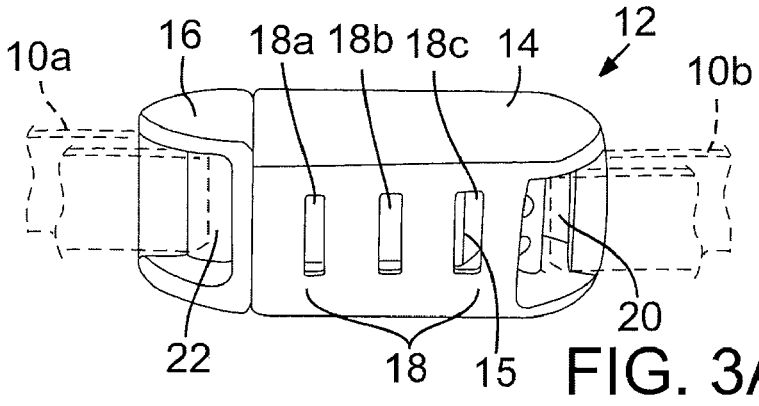
FIG. 3A is an enlarged view of the detaching structure of FIG. 1 showing a first possible engagement position offering a first possible release resistance.
Figure 3B:
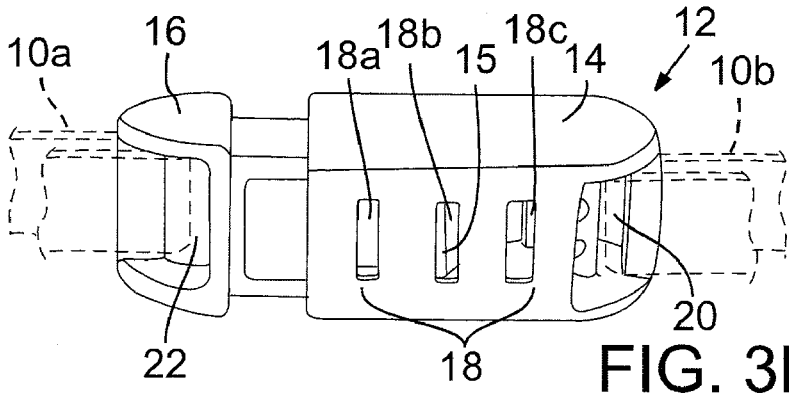
FIG. 3B is an enlarged view of the detaching structure of FIG. 3A showing a second possible engagement position offering a second possible release resistance.
Figure 3C:
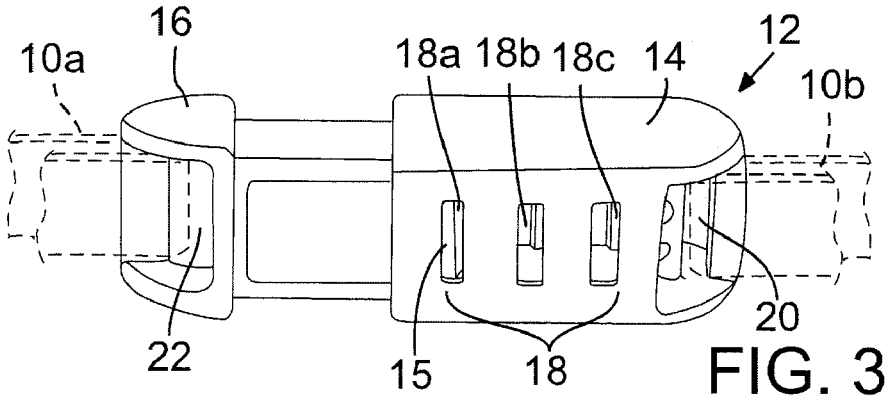
FIG. 3C is an enlarged view of the detaching structure of FIG. 3A showing a third possible engagement position offering a third possible release resistance.
Figure 3D:
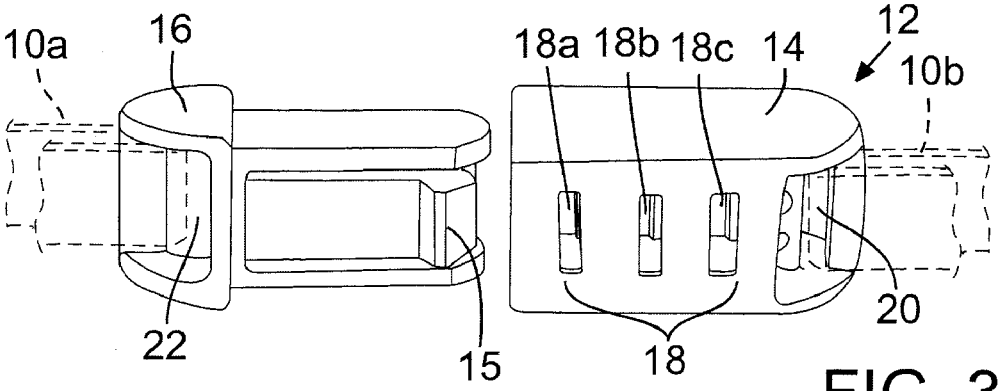
FIG. 3D is an enlarge view of the detaching structure of FIG. 3A showing a possible disengaged position

Preferably, at least three different release settings are engineered into the detaching structure so an athlete can first set it on the $3^{rd}$ clip position (pushed all the way in as shown in FIG. 3A) for the highest resistance. At this resistance level, the force required to "break" the female portion free from the two tab positions is preferably about 25 pounds. Athletes first using the training belt system 10 should start on this setting. As they progress, they can clip the detaching structure on the middle setting (medium resistance shown in FIG. 3B) or on the first setting (lightest resistance shown in FIG. 3C).

Alternatively, a plurality of spaced apart protrusions 15 may be positioned on each side of the male portion 16 and aligned so as to allow the user to select the number of protrusions 15 that will engage the openings 18*a*-*c*. For example, with three pairs of spaced apart protrusions 15 on the sides of the male portion 16, the user can position the male portion 16 so that each pair of protrusions operably engages one of the pair of openings 18*a*-*c*. This configuration provides the maximum amount of protrusions engaging the maximum amount of openings 18*a*-*c*, thereby providing the highest degree of release resistance.

To reduce the amount of release resistance, the user slides the male portion away from the female portion, so that fewer protrusions engage openings 18*a*-*c*. It can be appreciated that the least amount of release resistance can be achieved simply by continuing to slide the male portion away from the female portion so that only one pair of protrusions 15 operably engage one pair of openings 18*a*.

The detaching structure as previously described provides consistent and reliable tension each time. Moreover, the defined release resistance for each configuration will not degrade over time like with hook and loop material and the like. The detaching structure can also be used for additional resistance training if scaled up or used in its present form for additional reaction training drills.

Having described and illustrated the principles of our invention with reference to a preferred embodiment thereof, it will be apparent that the invention can be modified in arrangement and detail without departing from such principles. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

We claim:

1. A reaction training belt system comprising:

a first belt, wherein said first belt includes a first adjustment structure for adjustably securing the first belt around a waist of a wearer;

a second belt; and a detaching structure detachably securing said first belt to said second belt, said detaching structure includes a male portion secured to said first belt and a female portion secured to said second belt, wherein said male portion includes a protrusion extending therefrom and said female portion includes a plurality of recesses adapted to releasably engage said protrusion, each recess having a different size whereby a different degree of release resistance is created depending on which of said recesses said protrusion is positioned.

2. The reaction training belt system of claim 1, wherein said male portion is operably secured to a first position relative to said female portion to provide a first release resistance, and said male portion is operably secured to a second position relative to said female portion to provide a second release resistance.

3. The reaction training belt system of claim 1, wherein said second belt includes a second adjustment structure for adjustably securing the second belt around a waist of a second wearer.

4. The reaction training belt system of claim 1, wherein said male portion is slideably received within said female portion.

5. The reaction training belt system of claim 1, wherein said detaching structure including means for adjusting the release resistance between said first belt and said second belt.

6. A reaction training belt system comprising:

a first belt having a first adjustment structure for adjustably securing the first belt around a waist of a first wearer;

a second belt having a second adjustment structure for adjustably securing the second belt around a waist of a second wearer; and a detaching structure detachably securing said first belt to said second belt, said detaching structure includes a male portion secured to said first belt and a female portion secured to said second belt, said male portion is slideably receivable within said female portion, wherein the male portion including a protrusion extending therefrom and the female portion including a first recess and a second recess of different sizes whereby the resistance to releasing the protrusion at the first and second recesses varies dependent on the size of recess.

7. The reaction training belt system of claim 6, wherein the protrusion of the male portion engages the first recess of the female portion to provide a first release resistance, and the protrusion of the male portion engages the second recess of the female portion to provide a second release resistance, wherein the second release resistance is greater than the first release resistance.

8. The reaction training belt system of claim 6, wherein the first recess is sized smaller than the second recess.

9. The reaction training belt system of claim 8, wherein a degree of release resistance at which the protrusion disengages from the first recess is less than a degree of release resistance at which the protrusion disengages from the second recess.

10. The reaction training belt system of claim 6, wherein the female portion includes a third recess engageable by the protrusion of the male portion.

11. The reaction training belt system of claim 10, wherein the first recess is smaller than the second recess and the second recess is smaller than the third recess.

12. The reaction training belt system of claim 11, wherein a degree of release resistance at which the protrusion disengages from the first recess is less than a degree of release resistance at which the protrusion disengages from the second recess and the degree of release resistance at which the protrusion disengages from the second recess is less than a degree of release resistance at which the protrusion disengages from the third recess.

* * * * *